US009010023B2

(12) United States Patent
Chapman

(10) Patent No.: US 9,010,023 B2
(45) Date of Patent: Apr. 21, 2015

(54) BASE PLATE STRUCTURE FOR TRANSIT DOORS

(71) Applicant: Wabtec Holding Corp., Wilmerding, PA (US)

(72) Inventor: Matthew Chapman, Wheeling, IL (US)

(73) Assignee: Wabtec Holding Corp., Wilmerding, PA (US)

( * ) Notice: Subject to any disclaimer, the term of this patent is extended or adjusted under 35 U.S.C. 154(b) by 0 days.

(21) Appl. No.: 14/007,089

(22) PCT Filed: Sep. 24, 2012

(86) PCT No.: PCT/US2012/056853

§ 371 (c)(1),
(2) Date: Sep. 24, 2013

(87) PCT Pub. No.: WO2013/048944

PCT Pub. Date: Apr. 4, 2013

(65) Prior Publication Data

US 2014/0215757 A1 Aug. 7, 2014

Related U.S. Application Data

(60) Provisional application No. 61/541,361, filed on Sep. 30, 2011.

(51) Int. Cl.

| | |
|---|---|
| ***B61D 19/00*** | (2006.01) |
| ***E05D 15/16*** | (2006.01) |
| ***B61D 19/02*** | (2006.01) |

(52) U.S. Cl.

CPC ..... *B61D 19/02* (2013.01); *Y10T 16/364* (2015.01); *E05Y 2900/51* (2013.01); *E05Y 2800/176* (2013.01); *E05Y 2800/72* (2013.01); *E05F 15/53* (2015.01)

(58) Field of Classification Search

CPC ..... E05Y 2900/51; E05F 17/004
USPC ..... 49/116–118, 120, 366, 370; 160/117, 160/118, 119, 199, 206
See application file for complete search history.

(56) References Cited

U.S. PATENT DOCUMENTS

| | | | | | |
|---|---|---|---|---|---|
| 2,223,637 | A | * | 12/1940 | Newkirk | 49/110 |
| 2,298,158 | A | * | 10/1942 | Piron | 49/252 |
| 3,131,923 | A | * | 5/1964 | Werner et al. | 49/81.1 |
| 3,628,588 | A | * | 12/1971 | Dixon | 160/40 |
| 3,864,875 | A | * | 2/1975 | Hewitt | 49/115 |
| 4,087,939 | A | * | 5/1978 | Elguindy et al. | 49/118 |
| 4,272,923 | A | * | 6/1981 | Anderson | 49/360 |
| 4,346,533 | A | * | 8/1982 | Britzke et al. | 49/28 |
| 4,346,931 | A | | 8/1982 | Merkle | |
| 4,429,491 | A | * | 2/1984 | Bruns | 49/340 |
| 4,490,941 | A | * | 1/1985 | Mamach | 49/28 |
| 4,543,746 | A | * | 10/1985 | Racca | 49/118 |
| 4,735,018 | A | * | 4/1988 | Duncan et al. | 49/340 |

(Continued)

*Primary Examiner* — Katherine Mitchell
*Assistant Examiner* — Justin Rephann
(74) *Attorney, Agent, or Firm* — The Webb Law Firm

(57) ABSTRACT

According to this invention there is provided an adjustable base plate structure for a transit door comprised of a plurality of fixed dimension elements and a plurality of variable dimension elements for accommodating a plurality of door sizes and types. The base plate structure comprises a roller channel for spanning the width of the door and a center brace for being secured to the channel centered on the roller channel. Mounting brackets are secured to the vehicle or door frame and the roller channel.

5 Claims, 4 Drawing Sheets

(56) References Cited

U.S. PATENT DOCUMENTS

| | | | | | |
|---|---|---|---|---|---|
| 4,833,827 | A | * | 5/1989 | Bode et al. | 49/280 |
| 4,887,659 | A | * | 12/1989 | West | 160/199 |
| 5,242,005 | A | * | 9/1993 | Borgardt | 160/118 |
| 5,263,280 | A | * | 11/1993 | Dilcher | 49/212 |
| 5,332,279 | A | | 7/1994 | Golemis et al. | |
| 5,483,769 | A | | 1/1996 | Zweili | |
| 5,893,236 | A | | 4/1999 | Krbec et al. | |
| 6,125,768 | A | | 10/2000 | Kurnik | |
| 6,338,693 | B1 | * | 1/2002 | Scholten et al. | 477/7 |
| D458,118 | S | * | 6/2002 | Pfister | D8/400 |
| 6,754,990 | B2 | * | 6/2004 | Pedemonte | 49/337 |
| 7,017,974 | B2 | | 3/2006 | Tong et al. | |
| 2003/0000149 | A1 | | 1/2003 | Oakley et al. | |
| 2003/0188488 | A1 | * | 10/2003 | Carlsson et al. | 49/118 |
| 2004/0261319 | A1 | * | 12/2004 | Kennedy et al. | 49/339 |
| 2005/0132652 | A1 | * | 6/2005 | Tong et al. | 49/334 |
| 2008/0253841 | A1 | * | 10/2008 | Kennedy et al. | 405/144 |

* cited by examiner

BASE PLATE STRUCTURE FOR TRANSIT DOORS

BACKGROUND OF THE INVENTION

1. Field of the Invention

This patent relates to a base plate structure for securing the door shafts upon which door panels hang to the frame of a transit door and for supporting linear or rotary actuators for opening and closing the doors.

2. Description of Related Art

Transit doors comprising door panels that are supported from door shafts mounted at each side of the door opening are well known in the art and include outward swinging doors, slide-glide doors, bi-fold doors and outward swing plug doors. Most transit doors have a base plate positioned over the upper end of the doors for supporting door actuators and sometimes the door shafts to the vehicle wall or the door frame. Examples of transit vehicle doors are shown in U.S. Pat. Nos. 4,346,931; 5,332,279; 6,125,768 and 7,017,974.

It is an advantage according to this invention to provide an adjustable base plate structure for transit doors comprised of a plurality of fixed dimension elements and a plurality of variable dimension elements for accommodating a plurality of door sizes and types.

SUMMARY OF THE INVENTION

Briefly, according to this invention there is provided an adjustable base plate structure for a transit door comprised of a plurality of fixed dimension elements and a plurality of variable dimension elements for accommodating a plurality of door sizes and types. The base plate structure comprises a roller channel for spanning the width of the door and a center brace for being secured to the channel centered on the roller channel. Mounting brackets are secured to the vehicle or door frame and the roller channel. The mounting brackets support bearings for the door shaft. Actuators are mounted to the center brace. Upper braces are pivotally mounted to the ends of the center brace. The upper braces at one end are secured to the center brace and at the other end to the mounting brackets. The mounting brackets, actuators and upper braces are fixed dimension elements and the roller channel and center brace are variable dimension elements.

The center brace is a channel one web of which lies against the roller channel and has a pair of aligned holes in the webs of the channel at opposite ends for receiving pins for pivotally mounting actuators and upper braces. As is well understood in the art, the other ends of the actuators are connected directly or indirectly to levers fixed to the door shafts such that extension or retraction of the actuators will rotate the door shaft to cause the doors to open or close.

The roller channel has end flanges extending from each end and has holes for accommodating fasteners for securing to the mounting brackets. The roller channel has inboard facing flanges having two series of aligned holes for accommodating pins for securing the center brace to the roller channel and for pivotally securing one end of the actuator, which may comprise pneumatic cylinders and one end of the upper braces.

The mounting brackets are channels that have a U-shaped section defined by a web and two perpendicular flanges. The web has holes for accommodating fasteners for securing the web to the vehicle wall or door frame. The upper flanges of the mounting brackets have a slot for receiving a door shaft, holes for accommodating fasteners for securing a bearing for journaling the door shaft and holes for accommodating fasteners for securing an upper brace. The lower flange has openings for accommodating fasteners for securing the mounting bracket to the roller channel.

The mounting brackets, actuators and upper braces are fixed dimension elements useable with any door width and door type. The roller channel and center brace are variable dimension elements and must be sized to accommodate the width of the door opening and the type of door.

BRIEF DESCRIPTION OF THE DRAWINGS

Further features and other objects and advantages will become clear from the following detailed description made with reference to the drawings in which.

DESCRIPTION OF THE PREFERRED EMBODIMENTS

Figure 1:
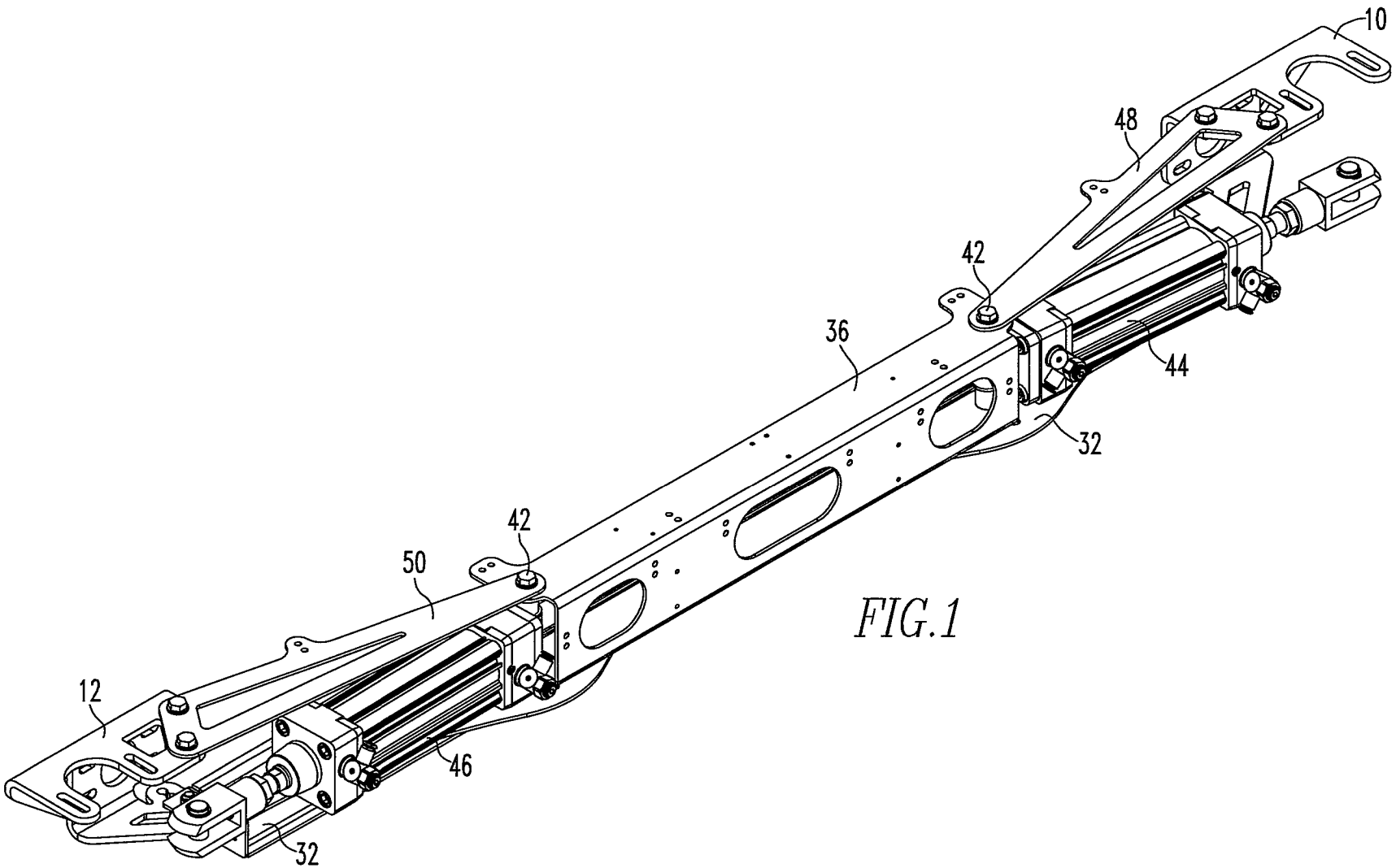
FIG. 1 is a perspective view of an assembled adjustable base plate structure for a transit door according to one embodiment of this invention.
Figure 2:
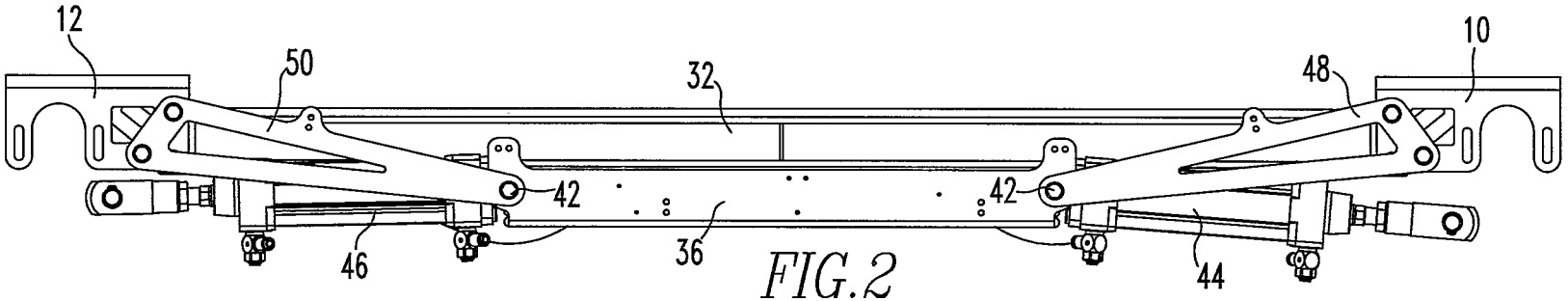
FIG. 2 is a top view of the base plate structure.
Figure 3:
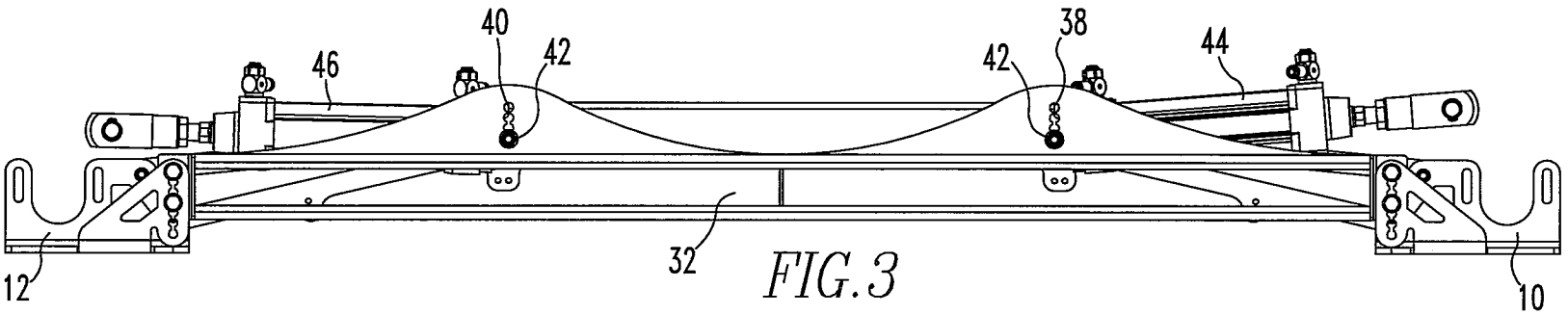
FIG. 3 is a bottom view of the base plate structure.
Figure 4:
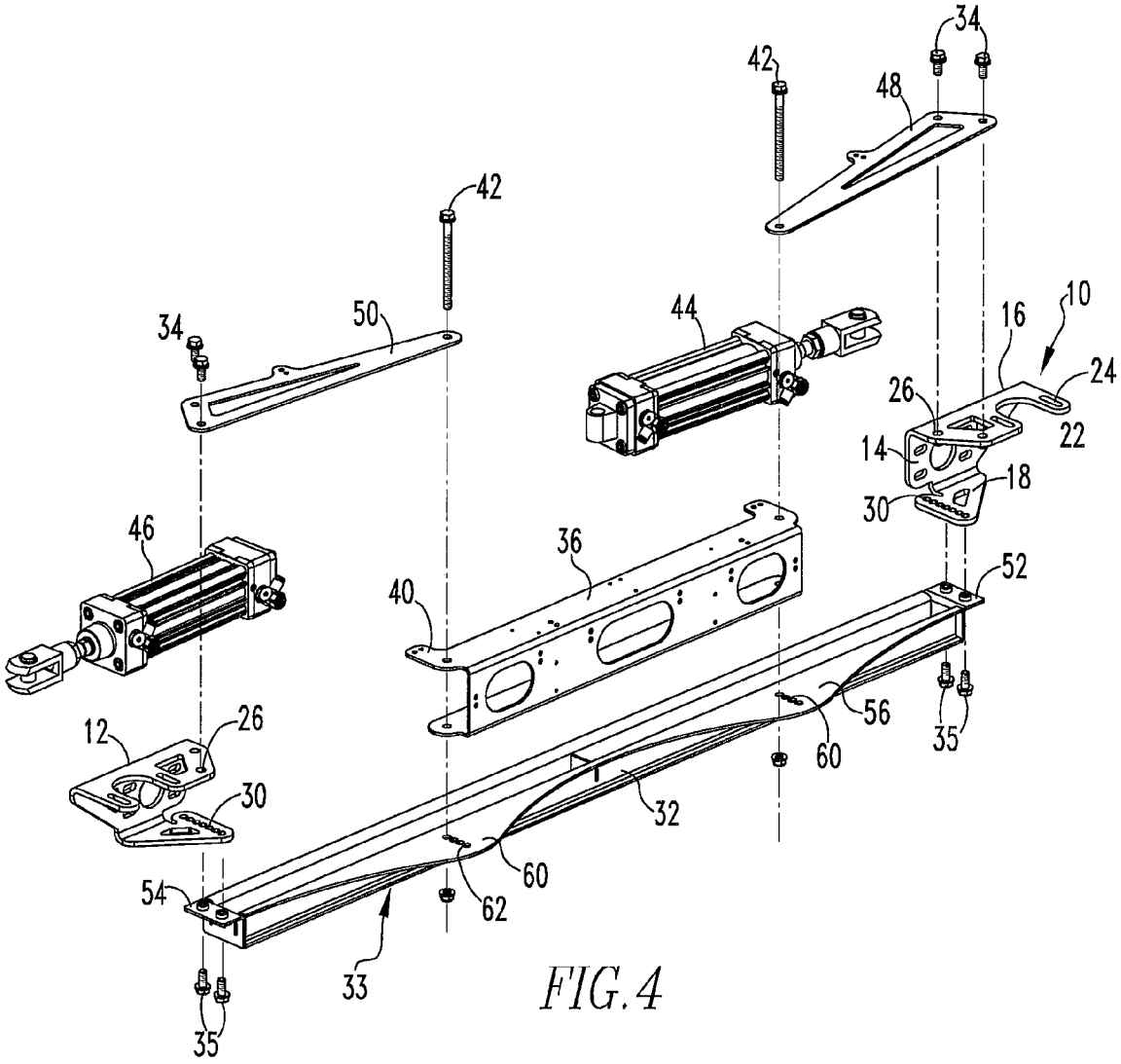
FIG. 4 is an exploded perspective view of the base plate structure according to this invention.
Figure 5:
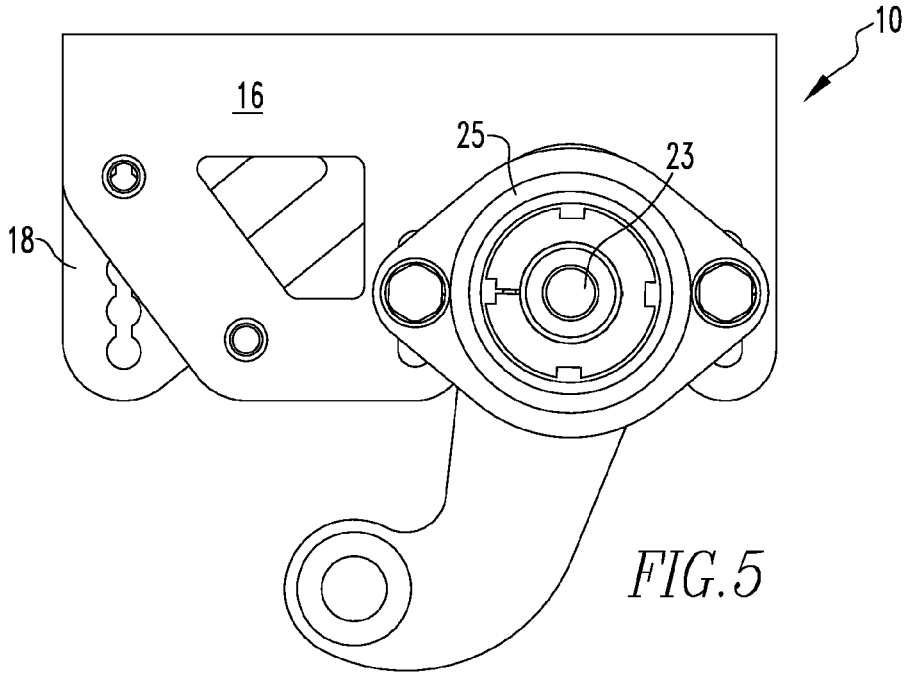
FIG. 5 is a top view of the mounting bracket with the associated bearing and door shaft.
Figure 6:
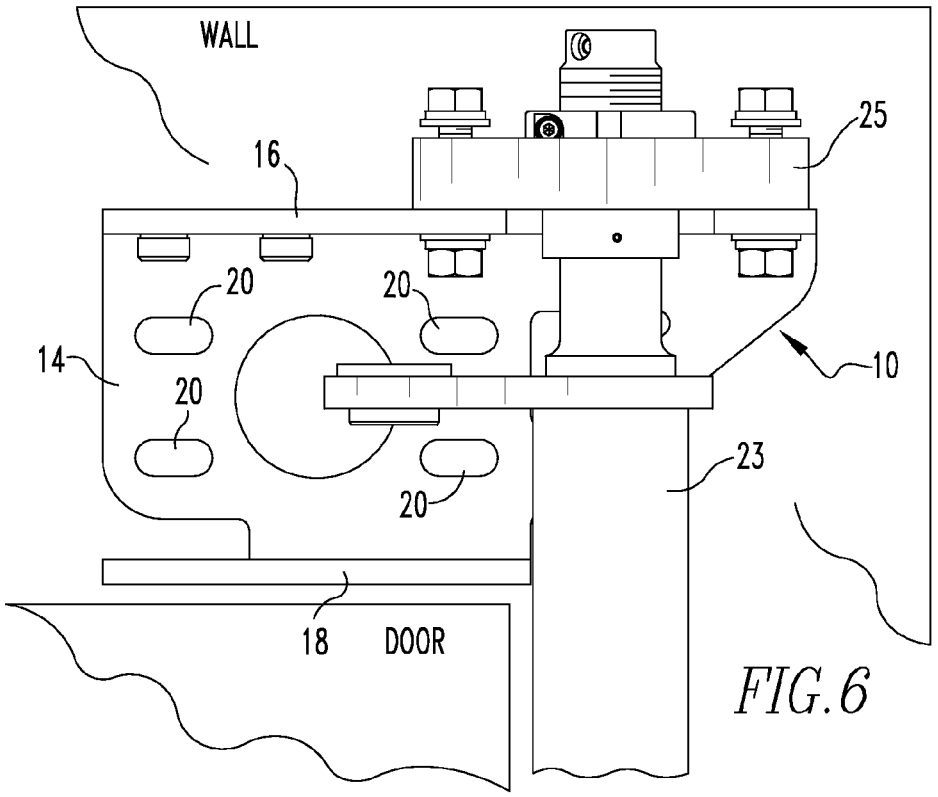
FIG. 6 is a front view of the mounting bracket with the associated bearing and door shaft.

Referring to FIGS. 1-6, the right and left mounting brackets 10, 12 are configured for mounting the remainder of the base plate structure to the vehicle wall or the door frame and above the door opening. The mounting brackets are channels that have a U-shape defined by a web 14 and perpendicular upper and lower flanges 16, 18. The web has holes 20 (see FIG. 6) for accommodating fasteners for securing the web to the vehicle wall or door frame. The upper flange 16 has an elongate slot 22 for receiving a door shaft 23 (see FIG. 4), elongate holes 24 for accommodating fasteners for securing a bearing 25 (see FIG. 4) for journaling the door shaft and holes 26 for accommodating fasteners for securing upper braces 48, 50. The lower flanges 18 have openings 30 for accommodating fasteners for securing the mounting brackets to the roller channel 32. The elongate slot 22 and elongate holes 24 in the upper flanges of the mounting brackets accommodate various linear positions of the base plate relative to the door shafts 23.

The roller channel 32 is fixed to the mounting brackets 10, 12. The roller channel defines an elongate roller groove used for guiding an edge of door panel during opening and closing for certain door types. The roller channel 32 is fixed to the mounting brackets using small fasteners (bolts) 34 positioned into the selected holes 30 in the mounting bracket to accommodate various tolerances of the door opening. This allows the roller channel 32 to be mounted at different inboard/outboard positions and thus to position the roller groove 33, used for example in the case of bi-fold and slide-glide doors, relative to the door shafts. Depending on the door geometry, the roller channel 32 can be mounted in different locations on the mounting brackets 10, 12. Thus, a standard support bracket can be used in a variety of transit vehicle applications.

The roller channel has end flanges 52, 54 extending from each end that have holes for accommodating fasteners 35 for securing to the mounting brackets 10, 12. The roller channel has inboard facing flanges 56, 58 having two series of aligned holes 60, 62 for accommodating pins for securing the center brace to the roller channel and for pivotally securing one end of the actuators which may comprise pneumatic cylinders and one end of the upper braces.

The center brace 36 is a channel one web of which lies against the roller channel 32. The center brace has a pair of aligned holes in the webs 38, 40 of the channel at opposite ends of the roller channel for receiving pins 42 for pivotally mounting linear actuators 44, 46 and upper braces 48, 50. Upper braces 48, 50 attach to either side of the mounting brackets 10, 12 and have a configuration to reduce weight while providing necessary structural support absorbing the reaction forces created during the lengthening or shortening of the linear actuators 44, 46. The ends of the roller channel 32 likewise absorb the reaction forces. The upper braces are of a standard configuration useful for a variety of applications. The pins 42 are bolts that also secure the center brace to the roller channel. The pivotal connections between the ends of the center brace 36 and the upper braces 48, 50 are significant. On some occasions the holes in the structure might be slightly off side-to-side and the center line of the door panel system will not match the center line of the door opening. The pivotal connection provided by pins 42 help to accommodate this problem.

The center brace 36 and the roller channel 32 may be made from easily fabricated material (rolling stock) and should be the only elements requiring varying dimensions on account of different door opening width and door geometry, for example.

LIST OF PARTS SHOWN IN THE DRAWINGS

10, 12 mounting brackets
14 web
16 upper flange
18 lower flange
20 holes
22 elongate slot
23 door shaft
24 elongate holes
25 bearing
26 holes
30 opening
32 roller channel
33 roller groove
34 fasteners
35 fasteners
36 center brace
38 upper web
40 lower web
42 pins
44, 46 linear actuator
48, 50 upper braces
52, 54 end flanges
56, 58 inboard facing flanges
60, 62 aligned holes Having thus defined my invention in the detail and particularity required by the patent laws what is desired protected by Letters Patent is set forth in the following claims.

The invention claimed is:

1. An adjustable base plate structure for a transit door in a wall of a transit vehicle comprised of a plurality of fixed dimension elements and a plurality of variable dimension elements for accommodating a plurality of door sizes of varying widths and types, said door being pivotally supported by at least one door shaft comprising:

a roller channel having first and second longitudinal ends, said roller channel dimensioned for spanning the width of the door;

a center brace having first and second longitudinal ends and being secured to the roller channel centered on the roller channel;

mounting brackets configured for being secured to the vehicle wall or a door frame in the vehicle wall and secured to the first and second longitudinal ends of said roller channel;

bearings supported in said mounting brackets for pivotally supporting the door shafts;

linear actuators pivotally mounted to the said first and second longitudinal ends of the said center brace; and upper braces having first and second ends, said upper braces being pivotally mounted at said first end to the center brace and secured at said second end to a mounting bracket;

whereby the center brace is a channel having parallel webs, one web of the channel lies against the roller channel, said center brace having a pair of aligned holes in the parallel webs of the channel at first and second longitudinal ends of the channel configured for receiving pins for pivotally mounting the linear actuators and upper braces, said pins being bolts that also secure the center brace to the roller channel, and whereby the mounting brackets, the linear actuators and the upper braces are fixed dimension elements and the roller channel and the center brace are variable dimension elements.

2. The adjustable base plate structure according to claim 1 in which the channel defines a roller groove.

3. The adjustable base plate structure according to claim 1 in which the mounting brackets are channels that have a U-shape defined by a web and two perpendicular flanges, the web having holes configured to accommodate fasteners for securing the web to the vehicle wall or door frame, an upper flange with a slot for receiving a door shaft, holes for accommodating fasteners for securing the bearing for the door shaft and holes for accommodating fasteners for securing an upper brace, and a lower flange with openings for accommodating fasteners for securing the mounting bracket to the roller channel.

4. The adjustable base plate structure according to claim 1 in which the roller channel has flanges extending from each longitudinal end and having holes positioned for accommodating fasteners for securing the roller channel to the mounting brackets and the roller channel has an inboard facing flange having two series of aligned holes positioned for accommodating pins for securing the center brace to the roller channel and for pivotally securing the actuators and the upper braces.

5. The adjustable base plate structure according to claim 1 in which the linear actuators are pneumatic cylinders.

* * * * *